United States Patent [19]

Vennike

[11] Patent Number: 4,879,949

[45] Date of Patent: Nov. 14, 1989

[54] REVERSE ANGLE DOCTOR BLADE ASSEMBLY

[75] Inventor: Torben Vennike, Holsted, Denmark

[73] Assignee: Ildvaco Engineering A/S, Gesten, Denmark

[21] Appl. No.: 195,154

[22] Filed: May 18, 1988

[51] Int. Cl.[4] ..... B41F 9/10

[52] U.S. Cl. ..... 101/157; 101/169; 101/350

[58] Field of Search ..... 101/153, 157, 169, 363–364, 101/366–367, 148, 210, 350

[56] References Cited

U.S. PATENT DOCUMENTS 3,568,636 3/1971 Lockwood ..... 101/366
4,590,855 5/1986 Schommer et al. .

FOREIGN PATENT DOCUMENTS 506516 4/1976 U.S.S.R. ..... 101/153

*Primary Examiner*—Eugene H. Eickholt
*Attorney, Agent, or Firm*—Burns, Doane, Swecker & Mathis

[57] ABSTRACT

A reverse doctor blade assembly dispenses and applies a liquid, such as ink or an adhesive, to the surface of a rotating transfer roll. The assembly has a reservoir chamber with a liquid inlet line and a liquid outlet line which are positioned to provide an optimum level of wetting liquid within the reservoir and a constant flow of liquid within the reservoir.

The cylindrical surface of the transfer roll is evenly terminated at each end with part of an ellipsoid face, and the doctor blade assembly includes doctor blades consisting of two parallel parts which contact the cylindrical surface and which are connected at each end with semi-elliptical doctor blade parts, each of which contacts one of the corresponding ellipsoid faces of the transfer roll.

12 Claims, 2 Drawing Sheets

REVERSE ANGLE DOCTOR BLADE ASSEMBLY

TECHNICAL FIELD

The invention relates to an apparatus wherein a rotation transfer or anilox roll applies a liquid such as ink to a rotating plate roll which transfers the liquid to the surface of a web of material. Alternatively, the liquid may be an adhesive which is applied by said transfer roll to a web to be glued to another web in the production of laminates. More particularly the invention is directed to such apparatus wherein a reverse angle doctor blade assembly meters liquid onto the anilox roll or printing cylinder from a reservoir which communicates with the roll or cylinder.

BACKGROUND OF THE INVENTION

In modern flexographic liquid application systems, a transfer roll such as an anilox roll is wetted by a liquid, for example ink or an adhesive, and is rotated to apply the liquid to the surface of an adjacent rotating plate roll. The plate roll has a rubber surface which is shaped or engraved to pick up liquid from the transfer roll and to deposit the liquid in a desired pattern on the surface of an adjacent moving web of material.

In a gravure system, the transfer roll is an engraved printing cylinder which transfers liquid in a desired pattern directly onto the surface of a web of material. In such known systems, the transfer roll picks up the wetting liquid from a trough or "fountain" and rotates to meter a desired amount of liquid onto the adjacent plate roll or web of material.

Rapidly rotating transfer rolls in known apparatus typically fling excess liquid radially and axially of the transfer roll during the liquid application process. It is known to utilize fluid deflectors or "slingers" at the ends of the transfer roll to direct at least a portion of the liquid flung from the roll back into the underlying trough or fountain. A substantial amount of liquid is lost in this process and liquid is also easily splashed or sprayed over the driving mechanism of the transfer roll or even over the web. Also, the liquid in the trough may thicken as a result of evaporation or contamination.

In U.S. Pat. No. 4,590,855 to Schommer et al. entitled Reverse Angle Doctor Blade Assembly with Stationary End Seal, a liquid transfer apparatus is disclosed which includes a transfer roll with stationary end seal support rings held in stationary sliding relation to the ends of the roll by spring biased pins. A reverse angle doctor blade assembly is positioned adjacent to the transfer roll to uniformly meter a wetting liquid to the moving surface of the roll.

The doctor blade assembly includes a reservoir which is held in liquid communication with the surface of the transfer roll. End seals of the reservoir sealingly engage the stationary end seal supports to provide a liquid seal between the reservoir and the transfer roll.

The end seals of the reservoir result in a rather complicated structure of this closed reservoir chamber whose shape will be characterized by corners which counteract effective washing of said liquid, such as ink or an adhesive by flushing, e.g., in connection with change of ink.

Accordingly, it is an object of the invention to provide a reservoir chamber without sharp corners and edges to which the ink may adhere during flushing.

Another object of the invention is to provide a reservoir chamber having a simpler structure than the known one and having a very small volume.

A further object of the invention is to provide a reservoir chamber which is completely sealed and which results in an extra large contact face between inks and transfer roll and therefore ensures dyeing at high rates.

SUMMARY OF THE INVENTION

In order to achieve the objects of the invention and to overcome the problems of the prior art, the liquid transfer apparatus of the invention includes a transfer roll which is evenly terminated at each end with part of an ellipsoid face. The doctor blade consists of two parallel parts which contact the cylindrical surface and are connected at each end with semi-elliptical doctor blade parts, which contact the corresponding ellipsoid face of said transfer roll.

The two parallel doctor blade parts as well as the two semi-elliptical doctor blade parts may suitably be manufactured as one integral piece.

The ellipsoid faces at each end of the transfer roll may be ball faces in particular, and the doctor blade parts engaged therewith may then be semi-circular.

DETAILED DESCRIPTION OF PREFERRED EMBODIMENTS

Figure 3:
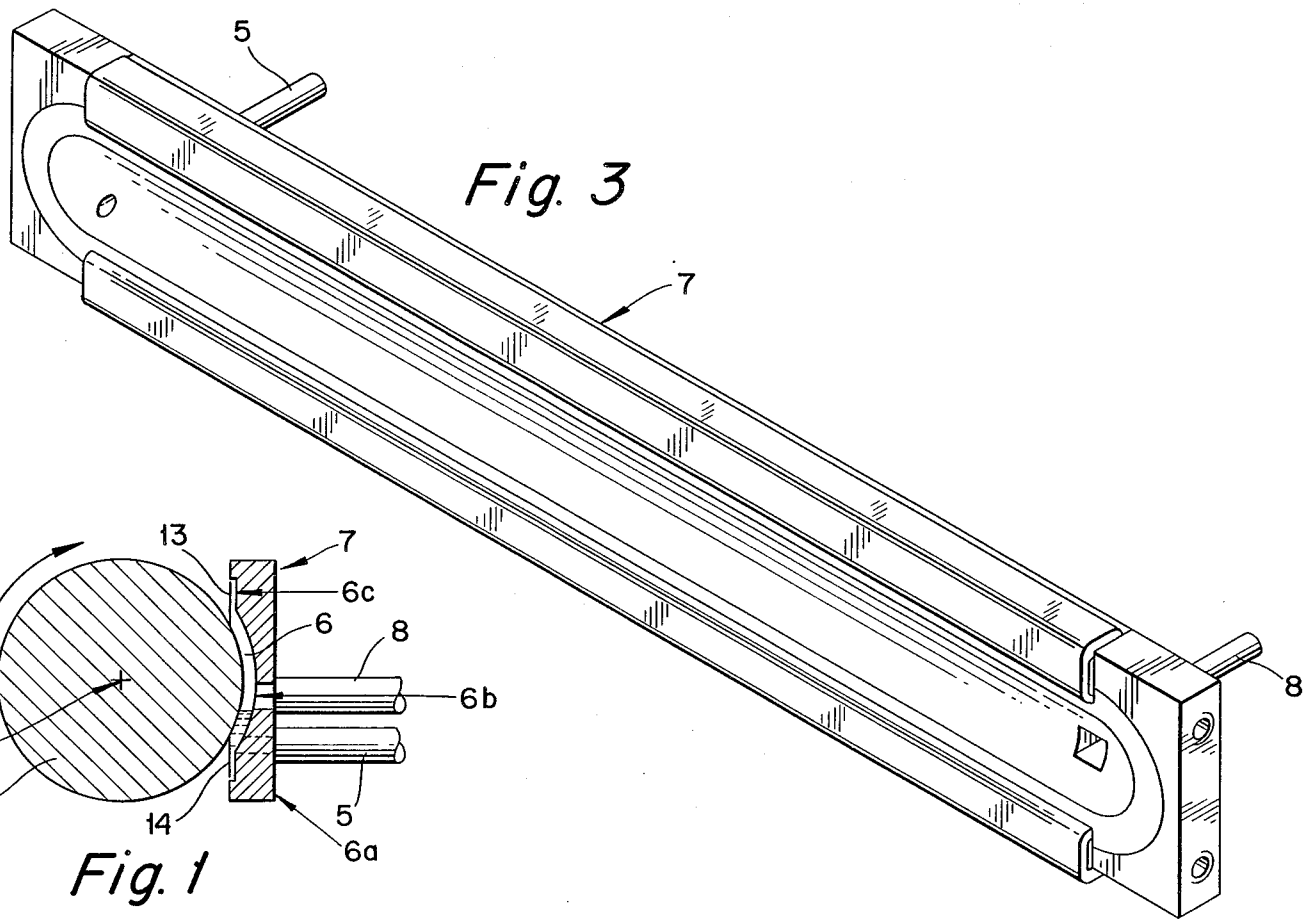
FIG. 3 shows a perspective view of the reverse angle doctor blade assembly.

The remaining portion of the specification will describe preferred embodiments of the invention when read in conjunction with the attached drawings, in which like reference characters identify identical apparatus.

Figure 2:
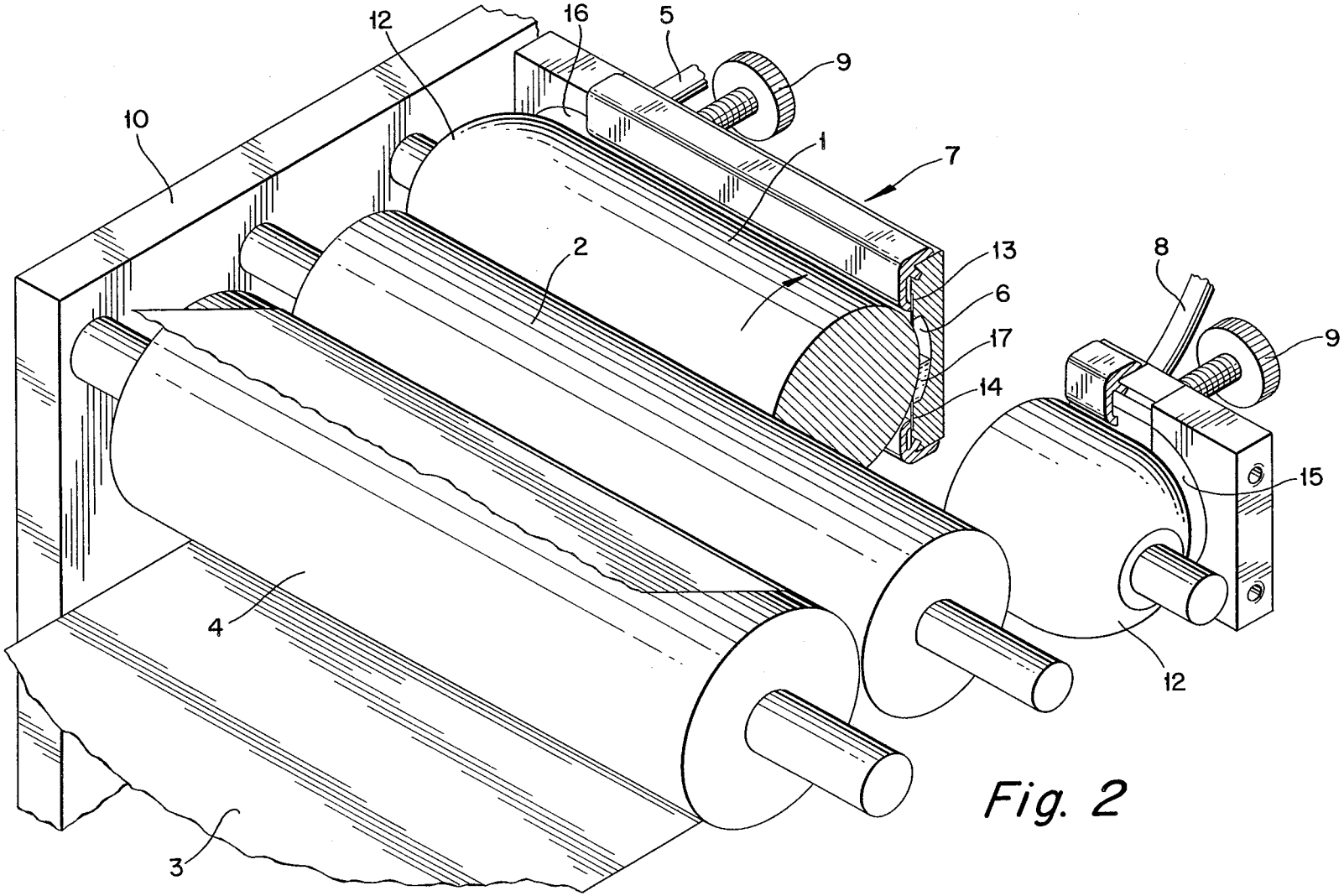
FIG. 2 shows a perspective, partially sectional view of a flexographic fluid transfer assembly of the invention.

As shown in FIG. 2, a transfer roll 1, such as an anilox roll, is rotated, e.g. in the direction indicated by the arrow, to apply a liquid, e.g. ink or an adhesive, to the surface of an adjacent plate roll 2. The surface of the plate roll 2 picks up liquid from the anilox roll 1 and transfers the liquid in a desired pattern to a web of material 3 which is pressed against the plate roll 2 by an impression roller 4.

In the following discussion the apparatus of an embodiment of the invention is described with respect to an anilox transfer roll, such as is used in a flexographic system. However, it should be understood that the transfer roll could also be an engraved cylinder such as is used in a gravure system, without departing from the invention. Accordingly, it should be understood that the term "transfer roll" as used hereafter can encompass either the engraved cylinder of a gravure system or the anilox roll of a flexographic system.

Figure 1:
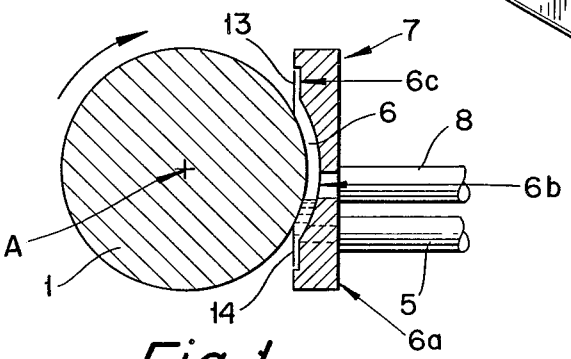
FIG. 1 schematically shows a cross-section through the reverse angle doctor blade assembly of the invention.

In operation of the system of FIG. 2, a wetting liquid is pumped through an inlet line 5 to a reservoir chamber 6 within a reverse angle doctor blade assembly 7. As shown in FIG. 1, the reverse angle doctor blade assembly 7 includes a housing **6*a* having a concave shaped recess 6*b* in a vertically extending face 6*c* of the housing 6*a* facing the transfer roll 1. The reservoir chamber 6 is thus defined by the recess 6*b* and the outer surface of the transfer roll 1, part of which is located between the bottom of the recess 6b and a plane containing the face 6c. The reservoir chamber 6 has a very small volume since the radius of curvature of the concave recess 6b closely approximates that of the transfer roll 1. The rotating surface of the transfer roll 1 defines one wall of the reservoir chamber 6 and is thus wetted by the liquid within the reservoir chamber 6. As known to those skilled in the art, wetting is achieved by filling microscopic pores which are formed in the surface of the roll 1. Excess liquid is removed by an outlet line 8 which is vertically adjusted to define a particular desired level of wetting liquid 17 and to maintain a constant flow of liquid within the reservoir chamber 6**.

The doctor blade assembly 7 is affixed to a mounting assembly 9, by which the doctor blade assembly 7 may be brought into and out of engagement with the transfer roll 1.

Shafts of each roll, that is, the transfer roll 1, plate roll 2 and impression roll 4, are journalled in both ends of a frame whose one support wall 10 is shown in FIG. 2.

Accordingly, a rotation axis A of the transfer roll 1 is located outside of the reservoir chamber 6, as shown in FIG. 1.

As appears from FIG. 2, both ends of the transfer roll 1 are rounded, the cylindrical surface merging evenly into an elliptical or spherical face 12, in particular a ball face.

In particular, the rounded ends 12 are tangent to and coterminous with the cylindrical surface of the transfer roll 1, as shown in FIG. 1.

An imagined axis-parallel plane section through the transfer roll 1 will thus form a semi-ellipse or a semi-circle, respectively, at the ends.

The drawings moreover show four doctor blade parts 13, 14, 15 and 16, of which the two first-mentioned doctor blade parts 13 and 14 contact the cylindrical part of the transfer roll 1, while the two last-mentioned doctor blade parts 15 and 16 are semi-elliptical and contact the ellipsoid ends 12 of the transfer roll 1.

The four doctor blade parts 13, 14, 15 and 16 are preferably made in one piece, as shown in FIG. 3.

The stated combination of the transfer roll 1 with the rounded ends and said doctor blade assembly 7 with the semi-elliptical or semi-circular parts 15, 16, depending upon whether the rounded ends are ellipsoid faces or ball faces, provides a sealed chamber 6 with a relatively small volume and therefore a great saving in the consumption of the liquid used. The completely sealed system moreover entails that the operators operating the apparatus will be exposed to unhealthy vapours from the solvents to a much smaller degree than before.

The invention may be embodied in other specific forms than those illustrated, without departing from its spirit or essential characteristics. The present embodiments are, therefore, to be considered in all respects as illustrative and not restrictive. The scope of the invention is indicated by the claims rather than by the foregoing description and, accordingly, all changes which come within the meaning and range of the equivalents of the claims are intended to be embraced therein.

We claim:

1. A liquid transfer apparatus, comprising:

reservoir means defining a reservoir chamber for holding liquid;

transfer roll means having ends mounted for rotation about an axis which does not pass through said reservoir chamber, said transfer roll means having a transfer surface intermediate said ends for rotating to retain a metered quantity of said liquid;

means for engaging said transfer roll means so that said transfer surface faces said reservoir chamber and rotating said transfer roll means about said axis so that said transfer surface retains liquid from said reservoir chamber;

at least one doctor blade means having an edge for removing excess liquid adhering to said transfer surface as said transfer roll means rotates;

the improvement being:

that said transfer roll means, which have an ordinary cylindrical surface, are evenly terminated at each end with part of an ellipsoid face, and that said doctor blade means consists of two parallel parts which contact said cylindrical surface, and which are connected at each end with semi-elliptical doctor blade parts which contact the corresponding elliptical face of said transfer roll means.

2. A liquid transfer apparatus of claim 1, wherein all parts of said doctor blade are made in one piece.

3. A liquid transfer apparatus of claim 1, wherein said parts of elliptical faces in particular are parts of ball faces, and said semi-elliptical doctor blade parts in particular are semi-circular.

4. A liquid transfer apparatus of claim 3, wherein all parts of said doctor blade are made in one piece.

5. A liquid transfer apparatus, comprising:

reservoir means defining a reservoir chamber for holding liquid;

transfer roll means mounted for rotation about an axis located outside of said reservoir chamber, said transfer roll means having a cylindrical transfer surface intermediate said ends for rotating to retain a metered quantity of said liquid;

means for engaging said transfer roll means so that said cylindrical transfer surface thereof rotates within a recess defining said reservoir chamber and rotating said transfer roll means about said axis so that said cylindrical transfer surface retains liquid from said reservoir chamber;

doctor blade means having an edge for removing excess liquid adhering to said cylindrical transfer surface as said transfer roll means rotates;

said transfer roll means having rounded axial ends tangent to and conterminous with said cylindrical transfer surface, said doctor blade means comprising two parallel parts which contact said cylindrical transfer surface and two semi-annular parts, each of which is connected to end faces of respective ends of the two parallel parts, the semi-annular parts contacting the rounded ends of the transfer roll means, the parallel parts and the semi-annular parts forming a seal between the transfer roll means and the reservoir chamber.

6. A liquid transfer apparatus of claim 5, wherein said parallel parts and said semi-annular parts of said doctor blade means comprise an integral one piece arrangement.

7. A liquid transfer apparatus of claim 5, wherein said rounded ends of said transfer roll means are spherical in shape and said semi-annular parts are semi-circular in shape.

8. A liquid transfer apparatus of claim 7, wherein said parallel parts and said semi-annular parts of said doctor blade means comprise an integral one piece arrangement.

9. A liquid transfer apparatus of claim 5, wherein said recess comprises a smooth concave shaped recess in a vertically extending face of a housing, said housing having an inlet therein for supply of liquid to said chamber and an outlet therein for removal of liquid from said chamber, said recess being formed by a surface having a radius of curvature closely approximating a radius of curvature of said cylindrical surface of said transfer roll means.

10. A liquid transfer apparatus, comprising:

reservoir means comprising a housing defining part of a reservoir chamber for holding liquid, the housing having a concave shaped recess in one vertically extending face thereof, said reservoir chamber being located in said recess;

transfer roll means mounted for rotation about an axis located outside of said reservoir chamber, said transfer roll means having a cylindrical transfer surface intermediate said ends for rotating to retain a metered quantity of said liquid, said transfer roll means having rounded axial ends tangent to and coterminous with said cylindrical transfer surface;

means for rotating and engaging said transfer roll means so that part of said cylindrical transfer surface is located between a vertical plane containing said vertically extending face of said housing and a bottom of said recess said cylindrical transfer surface forming another part of said reservoir chamber and said transfer roll means being rotatable about said axis so that said cylindrical transfer surface retains liquid from said reservoir chamber;

doctor blade means having an edge for removing excess liquid adhering to said cylindrical transfer surface as said transfer roll means rotates, said doctor blade means comprising a single closed loop piece of material pressed against said transfer roll means such that a seal is formed between said doctor blade means and said transfer roll means, said single piece having two parallel parts which contact said cylindrical transfer surface and two curved parts contacting the rounded axial ends of said transfer roll means.

11. A liquid transfer apparatus of claim 10, wherein said rounded ends of said transfer roll means are spherical in shape and said curved parts of said doctor blade means are semi-circular in shape.

12. A liquid transfer apparatus of claim 10, wherein said recess is formed by a surface having a radius of curvature closely approximating a radius of curvature of said cylindrical surface of said transfer roll means.

* * * * *